US005583306A

United States Patent [19]

Hayashida et al.

[11] Patent Number: 5,583,306

[45] Date of Patent: Dec. 10, 1996

[54] KEYBOARD MUSICAL INSTRUMENT HAVING JACKS CHANGEABLE IN ESCAPE SPEED BETWEEN ACOUSTIC SOUND MODE AND SILENT MODE

[75] Inventors: Hajime Hayashida; Satoshi Inoue; Takashi Aoyagi, all of Shizuoka, Japan

[73] Assignee: Yamaha Corporation, Japan

[21] Appl. No.: 464,045

[22] Filed: Jun. 5, 1995

[30] Foreign Application Priority Data

Jun. 13, 1994 [JP] Japan ..... 6-130267

[51] Int. Cl.[6] ..... G10D 15/00

[52] U.S. Cl. ..... 84/171; 84/220; 84/236; 84/719

[58] Field of Search ..... 84/171, 174, 220, 84/236, 423 R, 719

[56] References Cited

U.S. PATENT DOCUMENTS

| | | | |
|---|---|---|---|
| 2,250,065 | 7/1941 | Koehl | 84/171 |
| 4,633,753 | 1/1987 | Takahashi | 84/220 |
| 4,704,931 | 11/1987 | Nagai et al. | 84/171 |
| 4,744,281 | 5/1988 | Isozaki | 84/171 X |
| 4,970,929 | 11/1990 | Ishida | 84/220 |
| 5,115,705 | 5/1992 | Monte et al. | 84/617 |
| 5,247,129 | 9/1993 | Nozaki et al. | 84/615 |
| 5,374,775 | 12/1994 | Kawamura et al. | 84/615 |

FOREIGN PATENT DOCUMENTS

| | | |
|---|---|---|
| 68406 | 11/1890 | Germany . |
| 97885 | 10/1897 | Germany . |
| 44782 | 9/1898 | Germany . |
| 3707591 | 3/1987 | Germany . |
| 9-1U000077 | 3/1994 | Italy . |
| 51-67732 | 6/1976 | Japan . |
| 55-55880 | 4/1980 | Japan . |
| 62-32308 | 8/1987 | Japan . |
| 63-97997 | 4/1988 | Japan . |
| 4-174813 | 6/1992 | Japan . |
| 614303 | 2/1977 | Switzerland . |

*Primary Examiner*—Patrick J. Stanzione
*Attorney, Agent, or Firm*—Ostrolenk, Faber, Gerb & Soffen, LLP

[57] ABSTRACT

A keyboard musical instrument selectively generates acoustic sounds and electronic sounds depending upon a mode selected by a player, and has a hammer stopper for interrupting hammers before strikes at strings and an escape accelerator for accelerating an escape of a jack from the hammer assembly in the silent mode earlier than an escape in the acoustic sound mode, thereby preventing the hammer assembly from capture between the jack and the hammer stopper without deterioration of the piano key touch.

14 Claims, 12 Drawing Sheets

KEYBOARD MUSICAL INSTRUMENT HAVING JACKS CHANGEABLE IN ESCAPE SPEED BETWEEN ACOUSTIC SOUND MODE AND SILENT MODE

FIELD OF THE INVENTION

This invention relates to a keyboard musical instrument and, more particularly, to a piano-like keyboard musical instrument equipped with jacks changeable in escape speed between an acoustic sound mode and a silent mode.

DESCRIPTION OF THE RELATED ART

The piano usually generates loud sounds, and the loud sounds may disturb neighbors. For this reason, a piano is equipped with a muting mechanism, and the muting mechanism softens the piano sounds. If the muting mechanism inserts a muffler between the strings and the hammer assemblies, the hammer heads strike the strings through the muffler, and the muffler :rapidly absorbs the vibrations of the strings. As a result, the strings softly generate the sounds, and the muting mechanism prevents the neighbors from the loud sounds.

U.S. Pat. No, 2,250,065 discloses a prior art silent mechanism, and the disclosed silent mechanism picks up the hammer assemblies so as to cut off the functional relation between the key action mechanisms and the hammer assemblies. Even if a player depresses the keys, the depressed keys actuate the associated key action mechanisms: however, the key action mechanisms do not drive the hammer assemblies for rotation. The strings are not struck by the hammer assemblies, and a sound is not generated by the piano. If key sensors and/or hammer sensors are provided for the piano equipped with the silent mechanism, a tone generator may generate electronic sounds on the basis of player's fingering on the keyboard.

The prior art muting mechanism can not perfectly eliminate the sounds from the piano, and the prior art silent mechanism changes the key-touch unique to the acoustic piano, because the jacks do not drive the hammer assemblies. In detail, while a player is fingering on a keyboard, the depressed keys actuates the key action mechanisms only. Although the jacks behave as similar to the escape from the hammer butts or the hammer rollers, it is impossible to give the unique piano key touch, i.e., temporary heavy touch to the player. Player's finger feels light due to the elimination of the hammer weight.

Japanese Patent Application No. 4-174813 proposed a silent mechanism for an acoustic piano, and U.S. Ser. No. 08/073,092 was filed claiming the priority right on the basis of Japanese Patent Application No. 4-174813 together with other Japanese Patent Applications. Although several prior arts opposed against U.S. Ser. No. 08/073,092, the U.S. patent application was patented, and U.S. Pat. No. 5,374,775 was issued on Dec. 20, 1994. The references cited in the patent prosecution are U.S. Pat. Nos. 2,250,065, 4,633,753, 4,704,931 , 4,744,281 , 4,970,929, 5,115,705 and 5,247,129 and Foreign Patent documents 44782 (Germany) , 68406 (Germany) , 97885 (Germany) , 3707591 (Germany) and 370759C1 (Germany) , To9-1U000077 (Italy) , 51-67732 (Japan), 55-55880 (Japan), 62-32308 (Japan), 63-97997 (Japan) and 614303 (Switzerland).

The silent mechanism disclosed in U.S. Pat. No. 5,374,775 moves a stopper into and out of the paths of the hammer shanks, and the hammer shank rebounds on the stopper staying in the paths of the hammer shanks before an impact on the strings.

However, the silent mechanism disclosed in U.S. Pat. No. 5,374,775 requires a wide space between the strings and the hammer heads in the home position, and is hardly installed in a small-sized piano. In detail, when deformation of a hammer shank and the stopper is taken into account, the silent mechanism requires a gap ranging from 5 to 10 millimeters between the hammer heads and the strings at the rebound of the hammer shanks on the stopper. Although the escape point is variable depending upon the model of the piano, the standard escape point is regulated to 3 millimeters for low-pitched tones, 2.5 millimeters for middle-pitched tones and 2 millimeters for high-pitched tones, If the silent mechanism is installed between the hammer shanks and the strings, the hammer shanks are brought into contact with the stopper before the escape of the jacks from the hammer butts or the hammer rollers, and are caught between the stopper and the jacks. The regulating buttons are available for increasing the gaps between the escaping points and the strings. However, the player feels the key touch strange, because the jack escapes from the hammer butt/hammer roller earlier. Moreover, the jacks escaping earlier does not impart sufficient energy to the hammer butt/hammer roller, and the hammer head softly strikes the strings. As a result, the loudness is decreased, and the timbre is changed.

Thus, there is a trade-off between the prevention of undesirable capture of the hammer shanks and the standard piano sounds. The prevention of the undesirable capture is required in a performance without an acoustic piano sound, and the standard piano sounds are expected in a performance through the acoustic piano sounds. For this reason, Japanese Utility Model Application No. 5-56462 proposes a keyboard musical instrument equipped with a kind of changing mechanism for changing a gap between the regulating button and the toe of the jack, If a player wants a performance without an acoustic sound, the changing mechanism inserts a spacer into the gap between the toe of the jack an the regulating button, and causes the jack to escape earlier. The hammer assembly rebounds after the escape of the jack, and the undesirable capture does not take place. On the other hand, when the player tries a performance through the acoustic sounds, the changing mechanism retracts the spacer, and the jack escapes at the standard point. Then, jack can impart sufficient kinetic energy to the hammer assembly, and the hammer assembly strikes the strings as usual.

Another solution is proposed in Japanese Utility Model Application No. 5-38463, and another type of changing mechanism is incorporated in the keyboard musical instrument disclosed therein. The changing mechanism projects and retracts the regulating button per se, and changes the gap between a performance without an acoustic sound and a performance through acoustic sounds. The keyboard musical instrument achieves the same advantages as that disclosed in the former Japanese Utility Model Application.

However, the keyboard musical instrument disclosed in the former Japanese Utility Model Application encounters a problem in that the changing mechanism is complex. Another problem is an unintentional small gap between the spacer and the regulating button, and the unintentional gap causes the load exerted on the jack twice. As a result, the player feels a change of load at the contact between the jack and the spacer and at the contact between the spacer and the regulating button. Yet another problem is an aged deterioration of the spacer, and it is hard to keep the escaping points constant over the service time of the keyboard musical instrument.

The keyboard musical instrument disclosed in the latter Japanese Utility Model Application is free from the problems due to the spacer. However, a tuner is expected to appropriately regulate each of the regulating buttons in such a manner as to satisfy two escaping points, i.e., the escaping point for a performance without an acoustic sound and the escaping point for a performance through acoustic sounds. This tuning work is very difficult, and the tuning work is frequently required.

Moreover, a serious problem is encountered in both keyboard musical instruments disclosed in the Japanese Utility Model Applications in that the key-touch is varied between the performance without an acoustic sound and the performance through acoustic sounds, because the jacks are brought into contact with the regulating button or the spacer at different timings.

SUMMARY OF THE INVENTION

It is therefore an important object of the present invention to provide a keyDoard musical instrument a key touch of which is unchanged between a performance without an acoustic sound and a performance through acoustic sounds.

To accomplish the object, the present invention proposes to accelerate an escape of a jack during a performance without an acoustic sound.

In accordance with the present invention, there is provided a keyboard musical instrument having at least an acoustic sound mode for a performance through acoustic sounds and a silent mode for a performance without an acoustic sound, compromising: an acoustic keyboard instrument including a keyboard having a plurality of keys respectively assigned notes of a scale and selectively depressed by a player in both of the acoustic sound mode and the silent mode, a plurality of key action mechanisms functionally connected to the plurality of keys, respectively, and having respective jacks and a regulating sub-mechanism associated with the jacks, the jacks being brought into contact with the regulating sub-mechanism so as to start escapes when the plurality of keys are depressed by said player: in said acoustic sound mode, a plurality of hammer assemblies respectively associated with the plurality of key action mechanisms and respectively driven for rotation through the escapes of the jacks by the plurality of key action mechanisms when the player selectively depresses the plurality of keys, and a plurality of string means respectively assigned the notes and respectively struck by the plurality of hammer assemblies for producing acoustic sounds in the acoustic sound mode; and a silent system including a hammer stopper changed between a free position in the acoustic sound mode and a blocking position in the silent mode, the plurality of hammer assemblies being allowed to strike the plurality of string means without an interruption of the hammer stopper in the free position, the plurality of hammer assemblies rebounding on the hammer stopper in the blocking position before a strike at the string means, and an escape accelerator associated in the plurality of key action mechanisms and causing the jacks to complete the escapes in the silent mode earlier than the acoustic sound mode.

The keyboard musical instrument may further comprise an electronic system for generating electronic sounds instead of the acoustic sounds.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
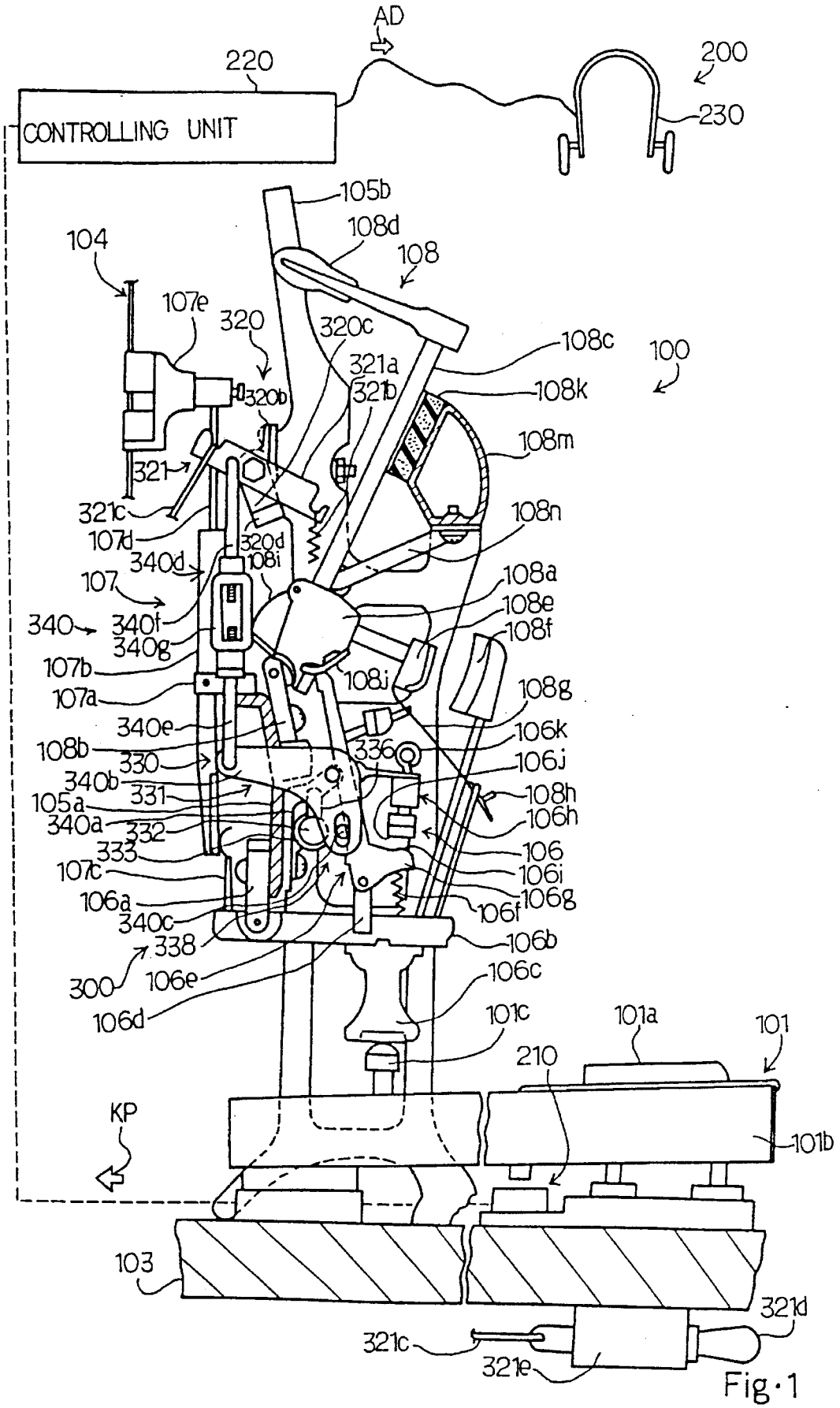
FIG. 1 is a partially cross sectional side view showing an essential structure of a keyboard musical instrument according to the present invention in an acoustic sound mode.
Figure 2:
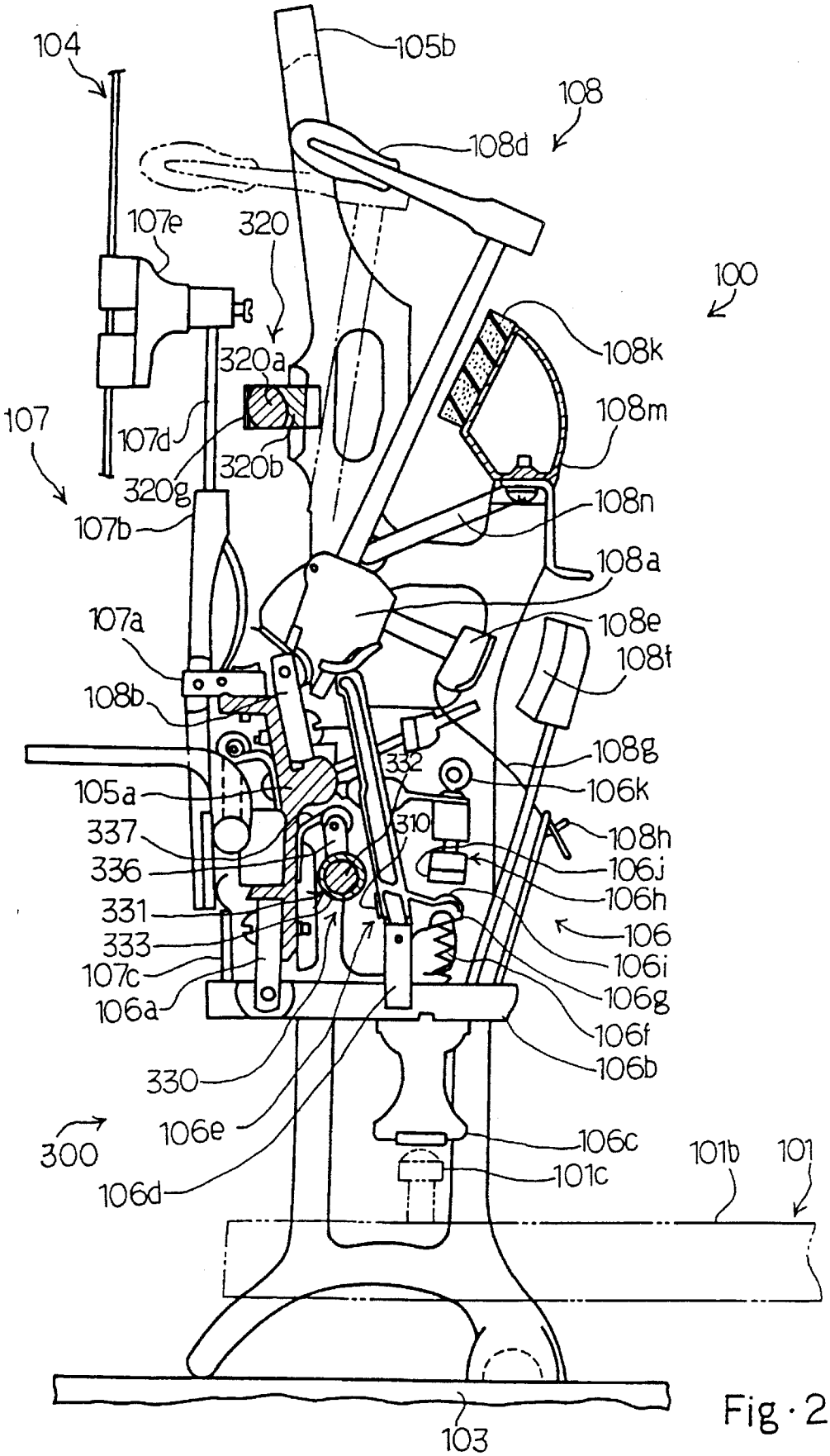
FIG. 2 is a partially cross sectional side view showing the essential structure of the keyboard musical instrument along a different section.

Referring first to FIGS. 1 and 2 of the drawings, a keyboard musical instrument embodying the present invention largely comprises an acoustic piano 100, an electronic system 200 and a silent system 300, and has at least an acoustic sound mode for a performance through acoustic sounds and an electronic sound mode for a performance without an acoustic sound. In the following description, word "front" means a position closer to a player than word "rear" and directions "clockwise" and "counter clockwise" are determined on a sheet where a rotating part is illustrated.

The acoustic piano 100 is an upright piano, and comprises a keyboard 101 provided over a key bed 103. Eighty-eight black and white keys 101*a* and 101*b* form the keyboard 101, and are turnable around balance pins (not shown). The black and white keys 101*a* and 101*b* extend in a fore-and-aft direction of the upright piano, and front end portions of the black and white keys 101*a* and 101*b* are exposed to a player. While a force is not being exerted by the player, the black and white keys 101*a* and 101*b* are staying in respective rest positions as shown in FIG. 1. When the player depresses the black and white keys 101*a* and 101*b*, the black and white keys 101*a* and 101*b* are downwardly moved, and arrive at respective end positions. Notes of a scale are respectively assigned to the black and white keys 101*a* and 101*b*, respectively.

The upright piano 100 further comprises a plurality of sets of strings 104 provided in front of a vertically extending frame (not shown) and stretched between tuning pins (not shown) and hitch pins (not shown).

A center rail 105*a* laterally extends in front of the strings 104, and is shared between all of the sets of strings 104. The center rail 105*a* is positioned over the rear end portions of the black and white keys 101*a* and 101*b*, and is bolted to action brackets 105*b* at both ends and an intermediate point thereof.

The upright piano 100 further comprises a plurality of key action mechanisms 106 functionally connected to the black and white keys 101*a* and 101*b*, a plurality of damper mechanisms 107 actuated by the key action mechanisms 106 and 101*b* for momentarily leaving the associated sets of strings 104 and a plurality of hammer assemblies 108 driven for rotation by the key action mechanisms 106. When the player depresses one of the black and white keys 101*a* and 101*b*, the depressed key 101*a*/101*b* causes the damper mechanism 107 to leave the set of strings 104, and actuates the key action mechanism 106 so as to rotate the hammer assembly 108. The hammer assembly 108 strikes the set of strings 104 in the acoustic sound mode, and the vibrating strings 104 generate an acoustic sound. When the player releases the key 101*a*/101*b*, the key action mechanism 106 and the hammer assembly 108 return to the initial positions or the home positions, and the damper mechanism 107 is brought into contact with the strings 104, thereby absorbing the vibrations of the strings 104.

The key action mechanisms 106 are similar in arrangement to one another, and each key action mechanism 106 comprises a whippen flange 106*a* bolted to a lower end portion of the center rail 105*a* and a whippen assembly 106*b* rotatably connected to the whippen flange 106*a*. The whippen assembly 106*b* has a heel 106*c* held in contact with a capstan screw 101*c* implanted into the rear end portion of the black or white key 101*a*/101*b*.

The key action mechanism 106 further comprises a jack flange 106*d* upright from a middle portion of the whippen assembly 106*b*, a jack 106*e* turnably supported by the jack flange 106*d*, a jack spring 106*f* inserted between the whippen assembly 106*b* and a toe 106*g* of the jack 106*e* and a regulating button sub-mechanism 106*h* opposed to the toe 106*g*. The jack 106*e* has an L-shape, and a swell 106*i* is formed in the upper portion of the toe 106*g*. The jack spring 106*f* urges the jack 106*e* in the counter clockwise direction at all times.

While the black or white key 101*a*/101*b* is staying in the rest position, the whippen assembly 106*b* is horizontally maintained, and the swell 106*i* of the toe 106*g* is spaced from the regulating button sub-mechanism 106*h*. The regulating button sub-mechanism 106*h* has a regulating button 106*j* projectable toward and retractable from the swell 106*i* by turning a regulating screw 106*k*. If the gap between the swell portion 106*i* and the regulating button 106*j* is increased, the jack 106*e* escapes from the hammer assembly 108 later. On the other hand, if the gap is decreased, the jack 106*e* escapes earlier.

When the toe 106*g* is brought into contact with the regulating button 106*j*, the reaction impedes the motion of the whippen assembly and, accordingly, the depressed key 101*a*/101*b*, and the player feels the key 101*a*/101*b* heavier than before. Thus, the jack 106*e* and the regulating button sub-mechanism 106*h* deeply concern a key-touch, and the position of the regulating button 106*j* defines the starting point of the escape of the jack 106*e*.

Figure 3:
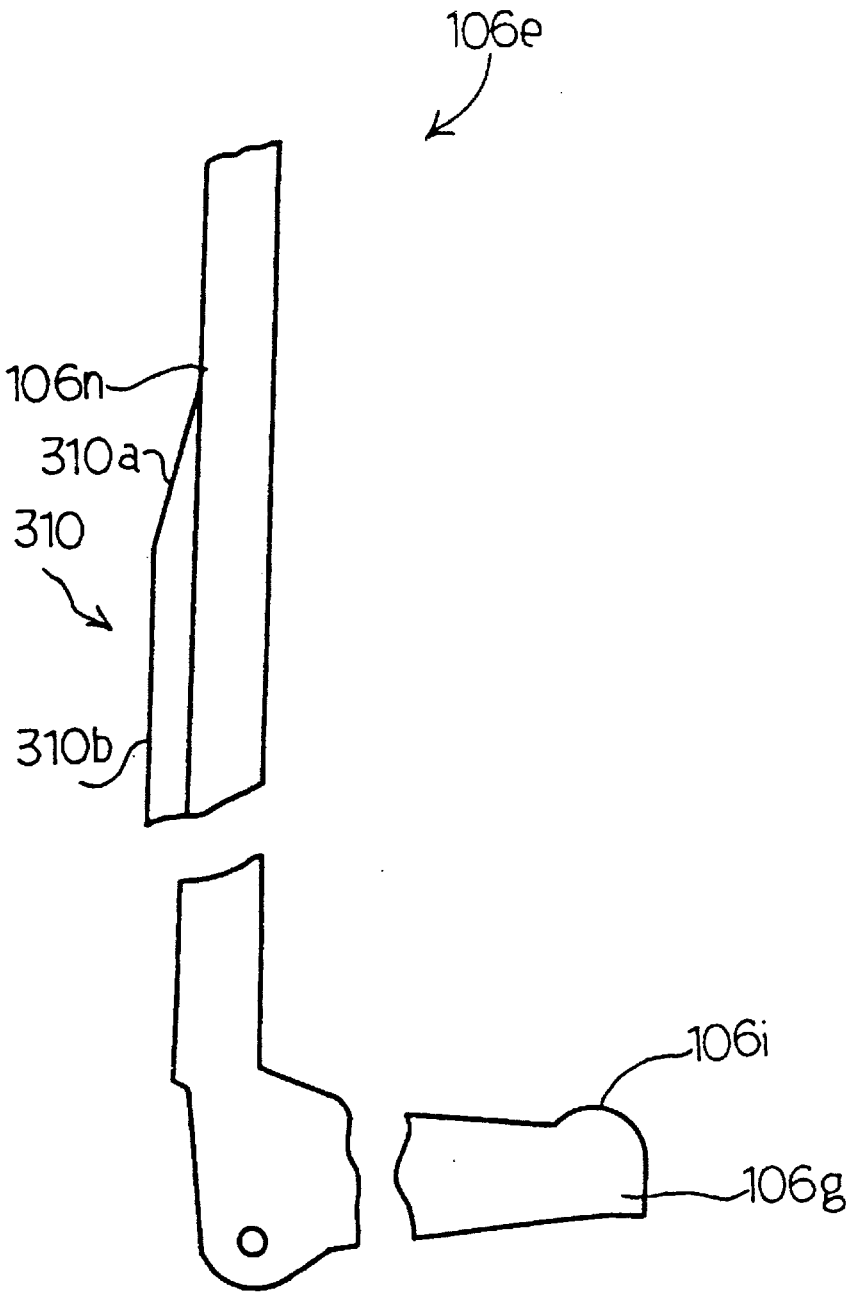
FIG. 3 is a side view showing a cam portion formed on a rear surface of a jack.

As shown in FIG. 3 of the drawings, a cam member 310 is attached to the rear surface of the jack 106*e*, and a slope 310*a* bridges the surface 106*n* of the jack 106*e* and a surface 310*b* of the cam member 310. As will be described hereinlater, the cam member 310 forms a part of the silent system 300.

Turning back to FIGS. 1 and 2, the damper mechanisms 107 are similar in arrangement to one another, and comprises a damper lever flange 107*a* fixed to an upper surface of the center rail 105*a*, a damper lever 107*b* rotatably supported by the damper lever flange 107*a*, a damper spoon 107*c* implanted into the rear end portion of the whippen assembly 106*b*, a damper wire projecting from the damper lever 107*b*, a damper head 107*e* fixed to the damper wire 107*d* and a damper spring (not shown in FIG. 1) urging the damper lever 107*b* in the counter clockwise direction.

While the black or white key 101*a*/101*b* is staying in the rest position, the damper spoon 107*c* does not push the damper lever 107*b*, and the damper head 107*e* is held in contact with the set of strings 104.

When the player depresses the black or white key 101*a*/101*b* from the rest position to the end position, the capstan screw 101*c* pushes up the whippen assembly 106*b*, and the whippen assembly 106*b* rotated in the counter clockwise direction causes the damper spoon 107*c* to rearwardly push the damper lever 107*b*. As a result, the damper lever 107*b* is rotated in the clockwise direction, and the damper head 107*e* leaves the set of strings 104.

On the other hand, when the black or white key 101*a*/101*b* is released, the whippen assembly 106*b* is rotated in the clockwise direction, and the damper spoon 107*c* removes the pressure from the damper lever 107*b*. As a result, the damper spring (not shown in FIG. 1) urges the damper lever 107*b* in the counter clockwise direction, and the damper head 107*e* is brought into contact with the set of strings 104 again.

The hammer assemblies 108 are also similar in arrangement to one another. Each of the hammer assemblies 108 comprises a hammer butt 108*a* turnably supported by a butt flange 108*b* fixed to the center rail 105*a*, a hammer shank 108*c* upwardly projecting from the hammer butt 108*a*, a hammer head 108*d* fixed to the leading end of the hammer shank 108*c*, a catcher 108*e* projecting from the hammer butt 108*a*, a back check 108*f* implanted into the front end portion of the whippen assembly 106*b*, a bridle tape 108*g* extending between the catcher 108*e*, a bridle wire 108*h* implanted into the front end portion of the whippen assembly 106*b* and a butt spring 108*i* urging the hammer butt 108*a* in the clockwise direction.

While the black or white key 101*a*/101*b* is staying in the rest position, the top surface of the jack 106*e* is in contact with a butt skin 108*j* attached to a lower surface of the hammer butt 108*a*, and the hammer shank 108*c* is resting on a hammer rail cloth 108*k* attached to a hammer rail 108*m*. The hammer rail 108*m* is supported through hammer rail hinges 108*n* by the action brackets 105*b*, and the hammer rail hinges 108*n* are turnably connected to the action brackets 105*b*. Though not shown in FIGS. 1 and 2, a soft pedal is connected to the hammer rail hinges 108*n*, and the angular position of the hammer rail 108*m* is changed by manipulating the soft pedal.

On the other hand, the depressed key 101*a*/101*b* rotates the whippen assembly 106*b* and the jack 106*e* around the whippen flange 106*a* in the counter clockwise direction, and the jack 106*e* rotates the hammer assembly 108 in the counter clockwise direction. The swell portion 106*i* is brought into contact with the regulating button 106*j* in the acoustic sound mode. Then, the jack 106*e* is rotated in the clockwise direction, and escapes from the hammer butt 108*a*. The jack escaping from the hammer butt 108*a* kicks the hammer butt 108*a*, and the hammer assembly 108 is rotated toward the set of strings 104. The hammer head 108*d* rebounds on the strings 104 in the acoustic sound mode, and the vibrating strings 104 generate the acoustic sound.

As described hereinbefore, when the swell portion 106*i* is brought into contact with the regulating button 106*j*, the jack 106*e* starts the escape. The escape is completed upon release of the hammer butt 108*a* from the jack 106*e*. When the jack 106*e* starts the escape, the friction between the top surface of the jack 106*e* and the butt skin 108 and the elastic force of the jack spring 106*f*, the player feels the depressed key heavier. When the hammer butt 108 is released, the player feels the key 101*a*/101*b* lighter, and the change of the load from the rest position to the end position is called as "key touch". The change of the load from the starting point of the escape to the completing point of the escape is called as "after touch", and strongly impresses the key touch on the player.

On the other hand, after the strike of the strings, the hammer assembly is rotated in the clockwise direction. When the key 101*a*/101*b* reaches the end position, the catcher 108*e* is brought into contact with the back check 108*f*. At this time, the motion of the key/key action mechanism is temporarily stopped. Thereafter, the player leaves the finger from the key, and all the components return to the initial positions. Even though the catcher 108*e* rebounds, the bridle tape 108*g* links the whippen assembly 106*b* with the hammer assembly 108, and prevents the set of strings 104 from a double strike. Moreover, while the player is repeating the key, the bridle tape 108*g* accelerates the returning motion of the hammer assembly. The jack spring 106*f* urges the jack 106*e* so as to come into contact with the butt skin 108*j* again.

The key action mechanisms 106, the damper mechanisms 107 and the hammer assemblies 108 are similar to those of a standard upright piano.

The electronic system 200 comprises a plurality of key sensors 210 respectively provided under the black and white keys 101*a* and 101*b* for producing key position signals KP, a controlling unit 220 responsive to the key position signals KP for generating an audio signal AD and a headphone 230 for generating electronic sounds. The key sensors 210 and the controlling unit 220 are similar to those disclosed in U.S. Pat. No. 2,250,065, and no further description is incorporated hereinbelow for the sake of simplicity.

The silent system 300 largely comprises a hammer stopper sub-system 320 and an escape accelerating sub-system 330, and the hammer stopper sub-system 320 is linked with the escape accelerating sub-system by means of a link sub-system 340 in this instance.

Figure 4:
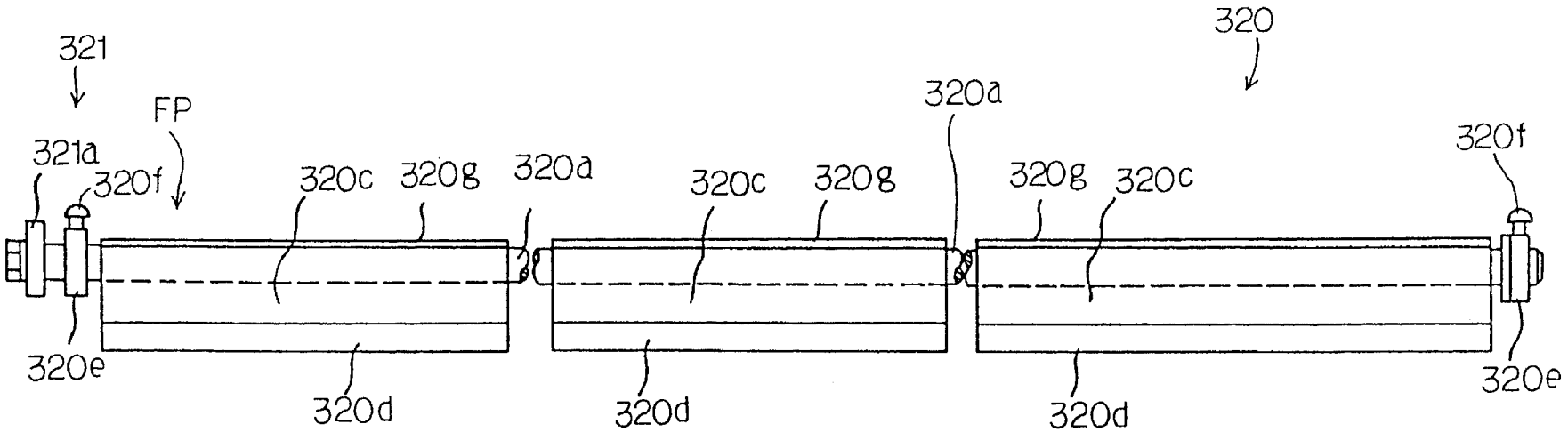
FIG. 4 is a front view showing a hammer stopper sub-system in a free position.
Figure 5:
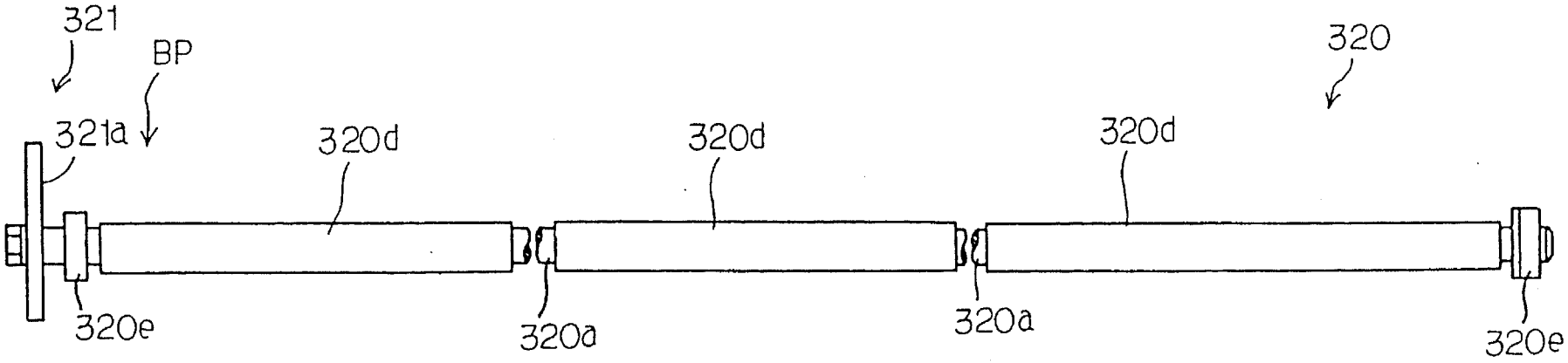
FIG. 5 is a front view showing the hammer stopper sub-system in a blocking position.
Figure 6:
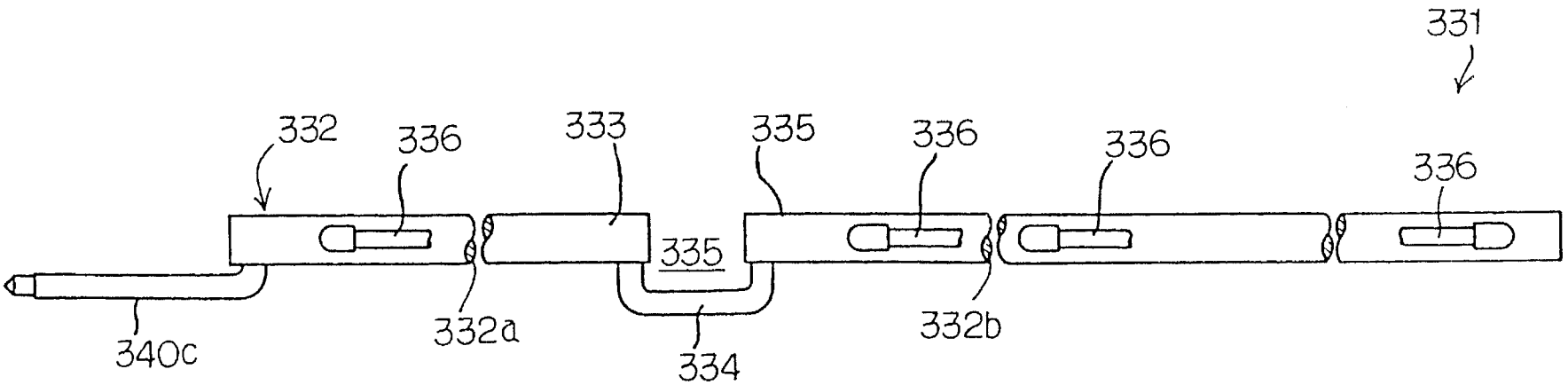
FIG. 6 is a front view showing a reaction generator in an inactive position.
Figure 7:
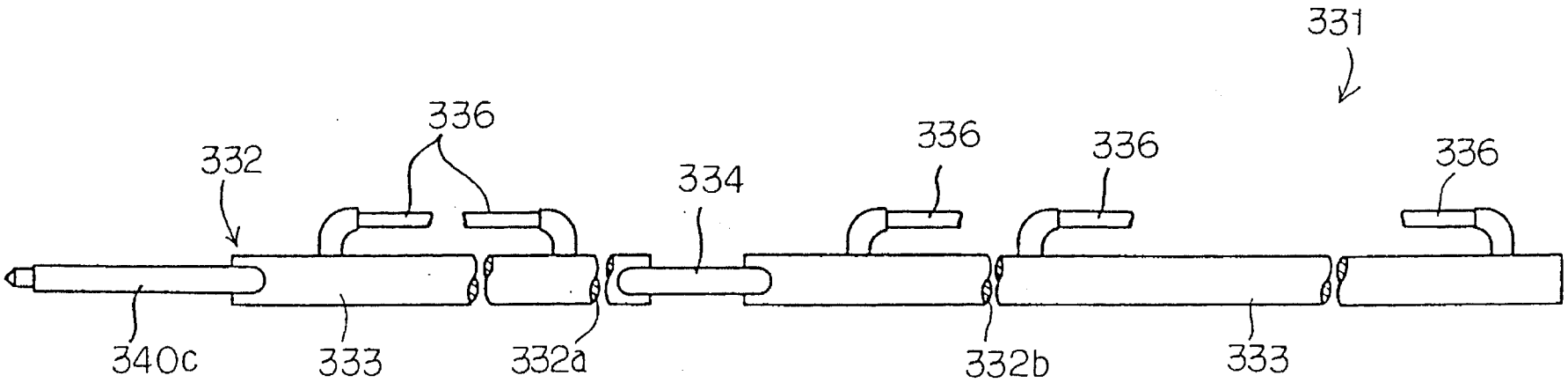
FIG. 7 is a front view showing the reaction generator in an active position.

FIGS. 4 and 5 illustrate the hammer stopper sub-system 320 in detail. The hammer stopper sub-system 320 includes a shaft member 320*a* rotatably supported by bearing units 320*b* (see FIG. 1) bolted to the action brackets 105*b*. The shaft member 320*a* horizontally extends in the lateral direction of the acoustic piano 100 between the strings 104 and the hammer shanks 108*c* at the home position.

The hammer stopper sub-system 320 further includes cushion brackets 320*c* attached to the shaft member 320*a* at intervals and cushion members 320*d* respectively fixed to the cushion brackets 320*c*. The cushion brackets 320*c* are associated with the strings for high-pitch tones, the strings for middle-pitch tones and the strings for low-pitch tones so that the bearing units 320*b* rotatably support the shaft member 320*a* at the action brackets 105*b*.

The hammer stopper sub-system 320 further includes a change-over mechanism 321 manipulative by the player for angularly moving the shaft member 320*a*, and the change-over mechanism 321 changes the hammer stopper sub-mechanism 320 between a free position and a blocking position. In detail, the change-over mechanism 321 has a lever 321*a* fixed to the shaft member 320*a*, a spring member 321*b* (see FIG. 1) urging the shaft member 320*a* in the clockwise direction, a flexible wire 321*c* engaged at one end thereof to the lever 321*a* and a nob 321*d* slidably supported by a bracket 321*e* fixed to the key bed 103 and connected to the other end of the flexible wire 321*c*.

While no pulling force is exerted on the nob 321*d*, the spring 321*b* urges the shaft member 320*a* so as to direct the cushion members 320*d* downwardly as shown in FIG. 4, and the hammer stopper sub-system 320 allows the hammer heads 108*d* to strike the sets of strings 104 without an interruption with the cushion members 320*d*. The position allowing the hammer heads 108*d* to strike the strings 104 is referred to "free position FP".

On the other hand, if the nob 321*d* is pulled, the flexible wire 321*c* rotates the lever 321*a*, and, accordingly, the shaft member 320*a* is rotated in the counter clock-wise direction against the elastic force of the spring 321*b*, and the cushion members 320*d* are opposed to the hammer shanks 108*c*. The position thus opposed to the hammer shanks 108*c* is referred to "blocking position BP".

If the player depresses the key 101*a*/101*b*, the jack 106*e* of the key action mechanism 106 rotates the hammer butt 108*a*, and, thereafter, the jack 106*e* escapes from the hammer butt 108*a*. The hammer assemblies 108 rushes toward the strings 104. However, the hammer shanks 108*c* rebound on the cushion members 320*d* in the blocking position BP before an impact on the strings 104, and the set of strings 104 does not generate an acoustic sound.

The jack 106*e* completes the escape from the hammer butt 108*a* at 6 to 8 millimeters between the hammer head 108*d* and the strings 104, and the hammer shank 108*c* rebounds on the cushion member 320*d* after the jack 106*e* completes the escape from the hammer butt 108*a*.

The hammer stopper sub-system 320 further includes stopper rings 320*e* fixed to the shaft member 320*a* by means of pins 320*f* and protective sheets 320*g* attached to the opposite surfaces of the cushion brackets 320*c*. The stopper rings 320*e* set limits on the axial motion of the shaft member 320*a*, and the shaft member 320*a* can not axially move over the stopper ring 320*e*. The protective sheets 320*g* is formed of artificial leather, cloth or felt, and take up impact of the damper wires 107*d*.

The escape accelerating sub-system 330 largely comprises the cam members 310 respectively attached to the jacks 106*e* and a reaction generator 331, and is changed between an active position and an inactive position. While the escape accelerating sub-system 330 is staying in the active position, the cam member 310 cooperates with the reaction generator 331 so as to convert a part of the force exerted on the whippen assembly 106*b* into a force exerted on the jack 106*e* for rotating it around the jack flange 106*d*.

The reaction generator 331 includes a shaft member 332 split into two parts 332*a* and 332*b*, cushion sheets 333 respectively wrapping the two parts 332*a* and 332*b* and a connecting rod member 334 connecting the two parts 332*a* and 332*b* to one another. The connecting rod member 334 is bent twice, and is shaped into a U-configuration. Therefore, the connecting rod member 334 forms a gap 335 between the two parts 332*a* and 332*b*, and the gap 335 allows the action bracket 105*b* provided at an intermediate portion of the center rail 105*a* to be without an interference with the reaction generator 331.

The reaction generator 331 further includes a plurality of rod members 336 fixed to the shaft member 332 at intervals and a plurality of bearing units 337 attached to the center rail 105*a*. The rod members 336 has a straight portions extending in parallel to the shaft member 332, and the straight portions of the rod members 336 are turnably supported by the bearing units 337. For this reason, the shaft member 332 is angularly movable around the bearing units 337, and the cushion sheets 333 becomes closer to or spaced from the rear surface of the jacks 106*e*.

The reaction generator 331 is linked with the hammer stopper sub-system 320 by means of the link sub-system 340 as described hereinbefore. The link sub-system 340 includes a bracket member 340*a* fixed to the center rail 105*a*, an inverted L-shaped arm member 340*b* turnably supported by the bracket member 340*a*, a connecting rod 340*c* inserted into a slot formed in one end portion of the inverted L-shaped arm member 340*b* and an adjusting mechanism 340*d* provided between the other end portion of the inverted L-shaped arm member 340*b* and the lever 321*a*.

When the spring member 321*b* urges the lever 321*a* in the clockwise direction, the elastic force of the spring member 321*b* is transferred through the adjusting mechanism 340*d* to the inverted L-shaped arm member 340*b*, and the inverted L-shaped arm member 340*b* is rotated in the clockwise direction around the bracket 340*a*. As a result, the cushion sheets 333 is spaced from the rear surfaces of the jacks 106*e*, and the reaction generator 330 remains in the inactive position.

On the other hand, if the nob 321*d* is pulled, the flexible wire 321*c* rotates the lever 321*a* in the counter clockwise direction, and the rotation of the lever 321*a* is transferred through the adjusting mechanism 340*d* to the inverted L-shaped arm member 340*b*. As a result, the inverted L-shaped arm member 340*b* is rotated in the counter clockwise direction, and the shaft member 332 and the cushion sheets 333 become closer to the rear surfaces of the jacks 106*e*. As a result, the reaction generator 330 causes the escape accelerating sub-system 330 to enter into the active position.

The adjusting mechanism 340*d* includes connecting bolt members 340*e* and 340*f* turnably connected to the inverted L-shaped arm member 340*b* and the lever 321*a* and a bracket member 340*g* formed with female threaded portions engaged with the connecting bolt members 340*e* and 340*f*, respectively. If the bracket member 340*g* turns in one direction, the connecting bolt members 340*e* and 340*f* are inserted into the bracket members, and the gap between the lever 321*a* and the inverted L-shaped arm member 340*b* is decreased. This means that the cushion sheets 333 become slightly spaced from the rear surfaces of the jacks 106*e*. On the other hand, if the bracket member 340*g* turns in the opposite direction, the gap is increased, and the cushion sheets 333 are slightly closer to the rear surfaces of the jacks 106*e*. Thus, the adjusting mechanism 340*d* appropriately regulates the reaction generator 331 at the active position.

Description is hereinbelow made on behaviors of the keyboard musical instrument in the acoustic sound mode and the silent mode.

Figure 8A:
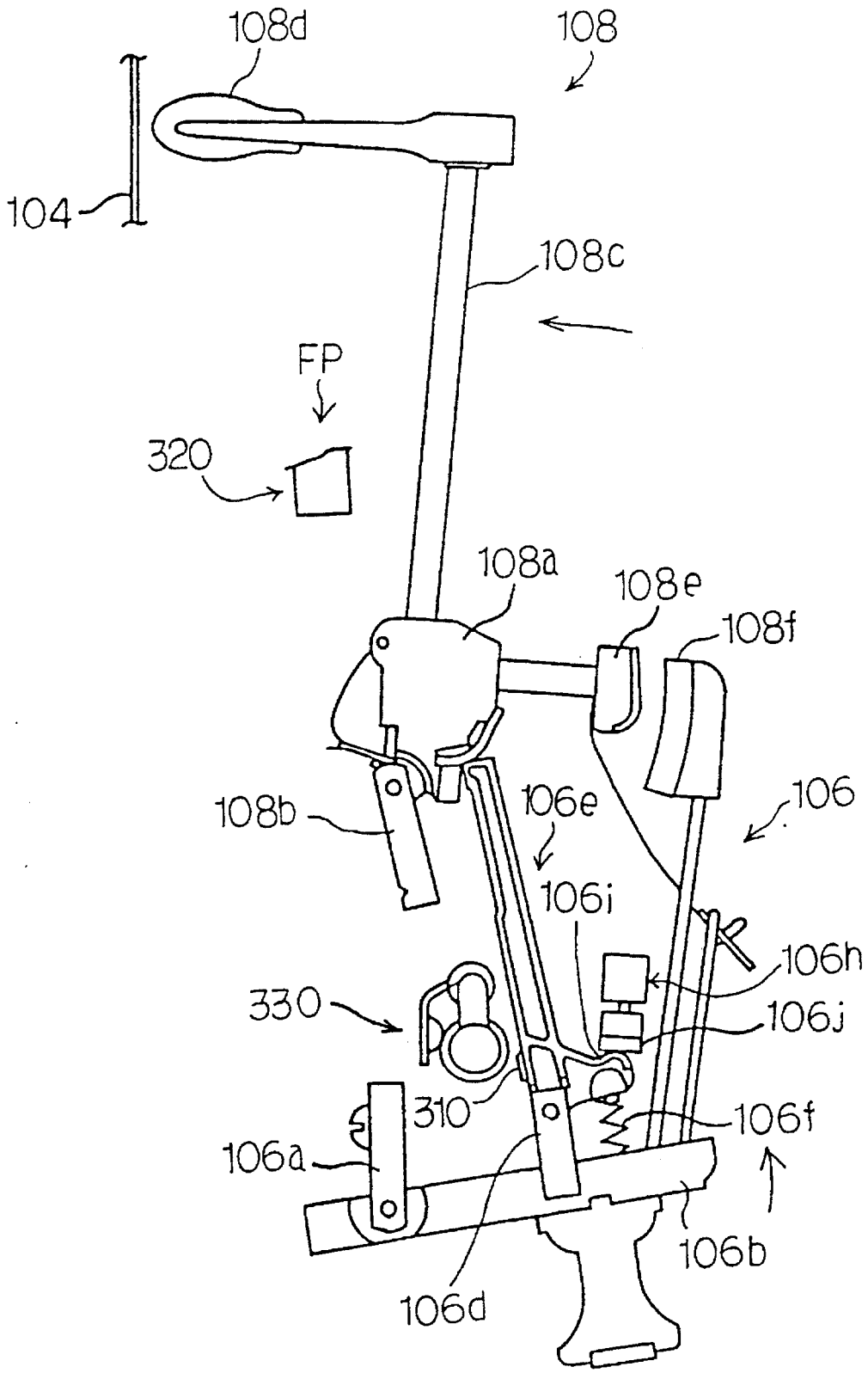
FIGS. 8A and 8B are side views showing a behavior of a key action mechanism and a hammer assembly in a performance through acoustic sounds.
Figure 8B:
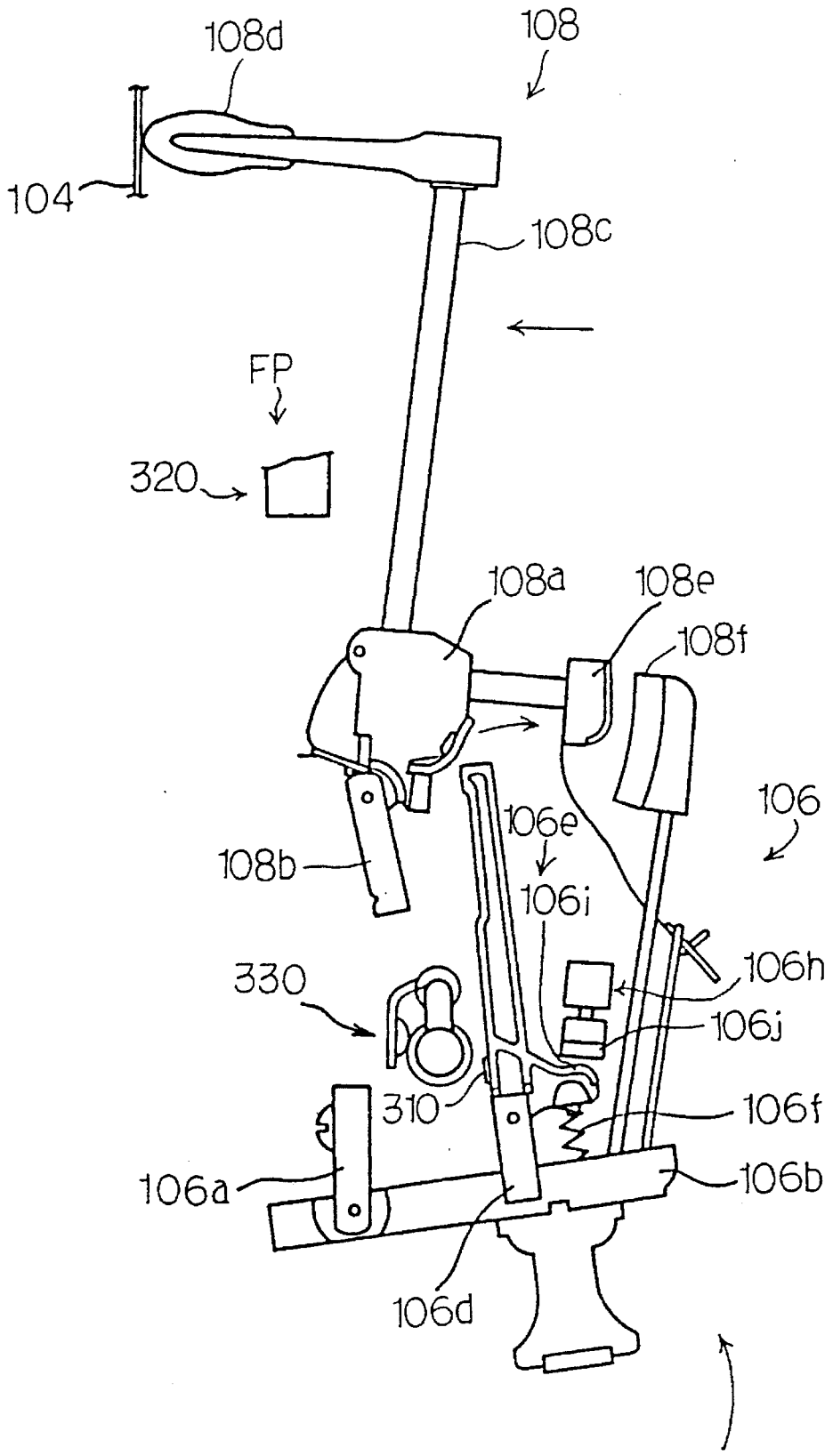

First, a player is assumed to perform a music through the acoustic sounds. The player does not manipulate the nob 321*d*, and the spring 321*b* pulls down the lever 321*a*. As a result, the hammer stopper sub-system 320 and the escape accelerating sub-system 330 remain in the free position FP and the inactive position, respectively, and the keyboard musical instrument is in the acoustic sound mode. FIGS. 8A and 8B illustrate the key action mechanism 106 and the hammer assembly 108 in the acoustic sound mode.

When the player depresses the white key 101*b* in the performance, the capstan button 101*c* pushes up the whippen assembly 106*b*, and the whippen assembly 106*b* and the jack 106*e* is rotated around the whippen flange 106*a* in the counter clockwise direction. The jack 106*e* is not rotated around the jack flange 106*d* until the swell portion 106*i* is brought into contact with the regulating button 106*j*. As a result, the jack 106*e* rotates the hammer assembly 108 in the counter clockwise direction.

When the swell portion 106*i* is brought into contact with the regulating button 106*j* as shown in FIG. 8A, the rotation of the whippen assembly 106*b* causes the jack 106*e* to rotate in the clockwise direction around the jack flange 106*d* against the jack spring 106*f*, and the jack 106*e* escapes from the hammer butt 108*a*. Thus, the jack 106*e* starts the escape at the contact with the regulating button 106*j*, and completes the escape from the hammer butt 108*a*. At this time, the escape accelerating sub-system 330 in the inactive position does not affect the motion of the jack 106*e*.

After the jack 106*e* escapes from the hammer butt 108*a*, the hammer head 108*d* rushes toward the set of strings 104. However, the hammer stopper sub-system 320 in the free position FP does not interrupts the hammer action. In other words, the hammer head 108*d* strikes the strings 104. In this instance, when the hammer reaches a point 2 to 3 millimeters spaced from the strings 104 by softly depressing the key not to strike the strings 104, the escape is completed.

The hammer head 108*d* rebounds on the set of strings 104 (as shown in FIG. 8B), and returns to the home position on the hammer rail cloth 108*k*. The set of strings 104 vibrates, and generates the acoustic sound.

Figure 9A:
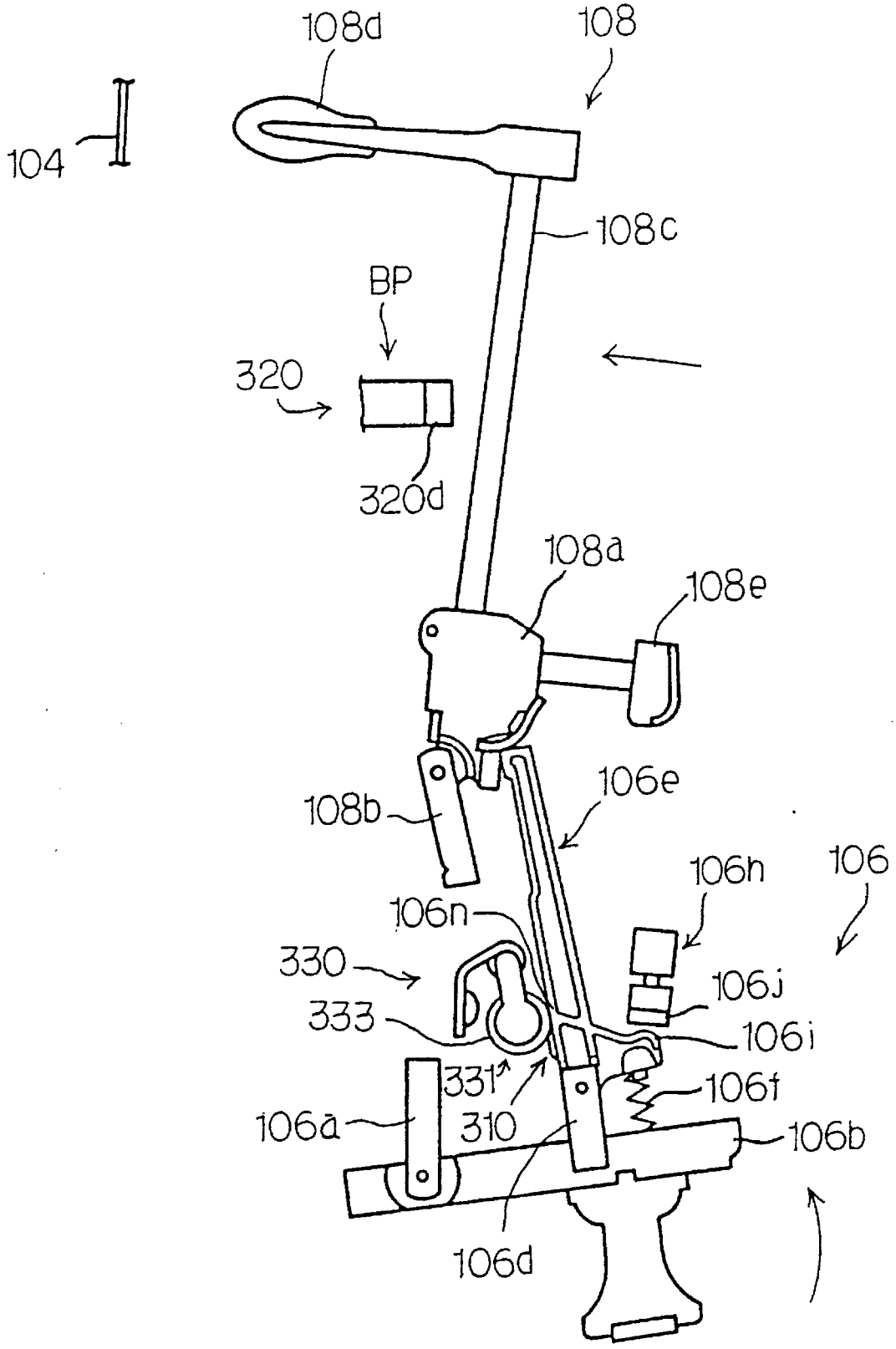
FIGS. 9A and 9B are side views showing a behavior of the key action mechanism, the hammer assembly and an escape accelerator in a performance without an acoustic sound.
Figure 9B:
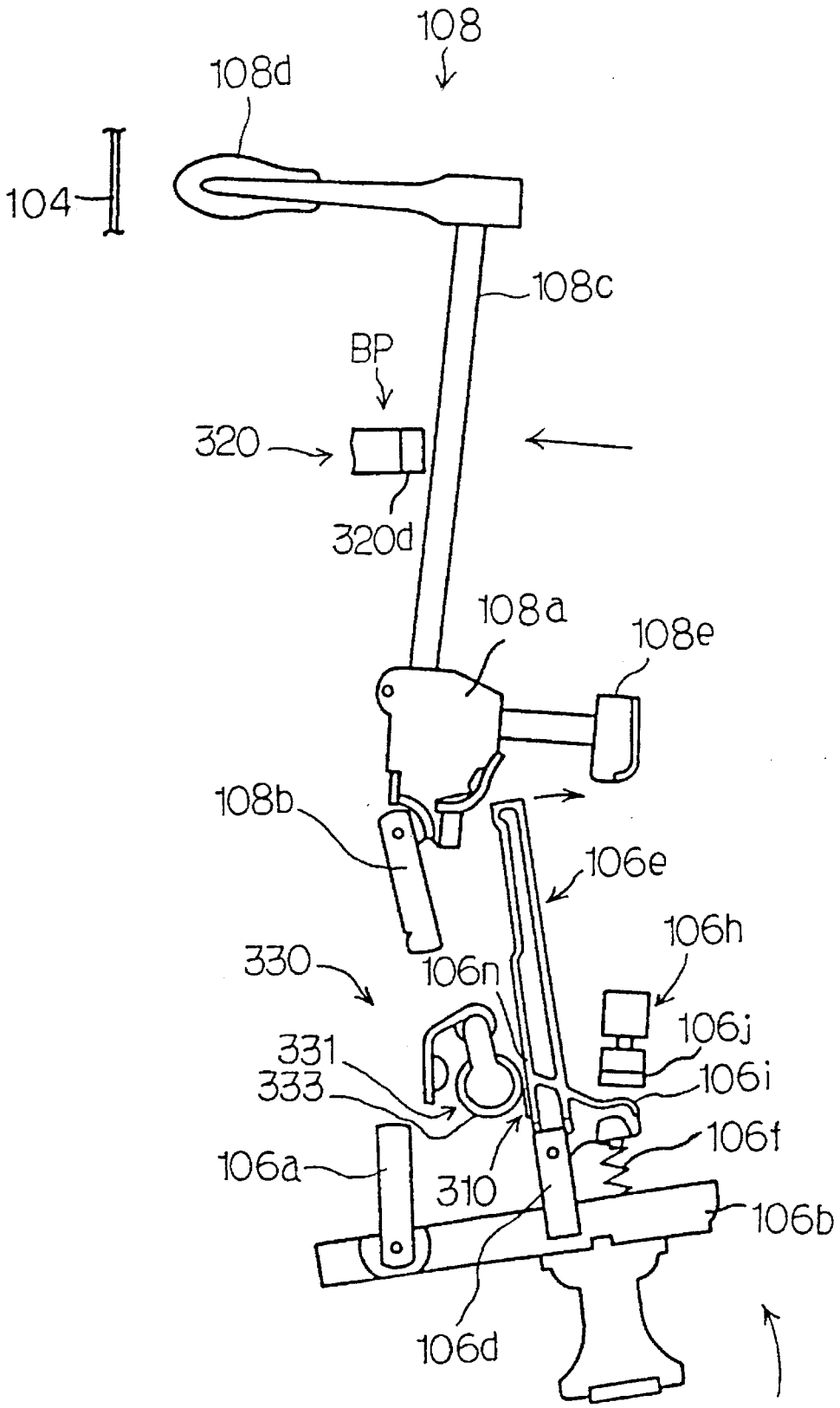

On the other hand, when the player wants to perform a music without an acoustic sound, the player pulls the nob 321*d*, and the flexible wire 321*c* rotates the lever 321*a* in the counter clockwise direction, and the hammer stopper sub-system 320 enters into the blocking position BP. The link sub-system 340 transfers the rotation of the lever 321*a* to the reaction generator 3310, and the escape accelerating sub-system 330 enters into the active position. Thus, the keyboard musical instrument enters into the silent mode. FIGS. 9A and 9B illustrate the key action mechanism 106 and the hammer assembly 108 in the silent mode.

Assuming now that the player depresses the white key 101*b* in the silent mode, the capstan button 101*c* pushes up the whippen assembly 106*b*, and the whippen assembly 106*b* and the jack 106*e* is rotated around the whippen flange 106*a* in the counter clockwise direction. The rear surface 106*n* of the jack 106*e* is brought into contact with the cushion sheet 333 of the reaction generator 331 before the contact between the swell portion 106*i* and the regulating button 106*j* as shown in FIG. 9A. However, the jack 106*e* does not start the rotation around the jack flange 106*d*.

After the contact with the reaction generator 331, the capstan button 101*c* is upwardly pushing the whippen assembly 106*b* and the jack 106*e*, and the contact point with the reaction generator 331 is moved along the slope 310*a* (see FIG. 3) of the cam member 310. While the reaction generator 331 is sliding on the slope 310*a*, a part of the force for the rotation of the whippen assembly 106*b* is converted to a force exerted on the jack 106*e* for rotating in the clockwise direction. As a result, the jack 106*e* rapidly escapes from the hammer butt 108*a*, and the escape of the jack 106*e* is completed at an earlier position where the hammer head 108*d* reaches 6 to 8 millimeters from the strings 104.

The sliding motion along the slope 310*a* exerts a load against the white key 101*b*. However, the load is approximately equal to that in the acoustic performance. Even though the jack 106*e* completes the escape earlier than the escape in the acoustic sound mode, the load is exerted to a finger of the player at the contact with the reaction generator 331 substantially concurrent to the contact between the swell portion 106*i* and the regulating button sub-system 106*j*, and the player feels the key touch unchanged.

After the escape, the hammer heads 108 rushes toward the set of strings 104 as shown in FIG. 9B, and the hammer shank 108*c* rebounds on the cushion member 320*d* before a strike at the strings 104. Thus, the hammer stopper sub-system 320 prevents the set of strings 104 from the strike of the hammer head 108*d*, and the set of strings 104 do not vibrate.

The escape of the jack 106*e* in the silent mode is completed earlier than the escape in the acoustic sound mode, and, for this reason, the hammer shank 108 does not get between the jack 106*e* and the cushion member 320*d*.

After the rebound on the cushion member 320*d*, the hammer assembly 108 returns to the home position.

As will be appreciate from the foregoing description, although the escape accelerating sub-system 330 according to the present invention causes the jack 106*e* to complete the escape from the hammer butt 108*a* earlier than the regulating button 106*j*, the change of the load exerted to the key 101*a*/101*b* moving from the rest position to the end position is substantially same as the regulating button 106*j*. For this reason, the player feels the key touch unchanged between the acoustic sound mode and the silent mode without a capture of the hammer shank 108*c* between the jack 106*e* and the hammer stopper sub-system 320.

Moreover, the regulating button mechanism 106*h* is adjustable independently from the adjustment work on the reaction generator 331, and the assembling work and the adjusting work/ the tuning work are easier than the keyboard musical instrument disclosed in Japanese Utility Model Application No. 5-38463.

The escape accelerating sub-system 330 according to the present invention is simpler than the spacers insertable beneath the regulating buttons in the silent mode and disclosed in Japanese Utility Model Application No. 5-56462, and the reaction generator 331 is less affectable by an aged deterioration rather than the spacers.

Second Embodiment

Figure 10:
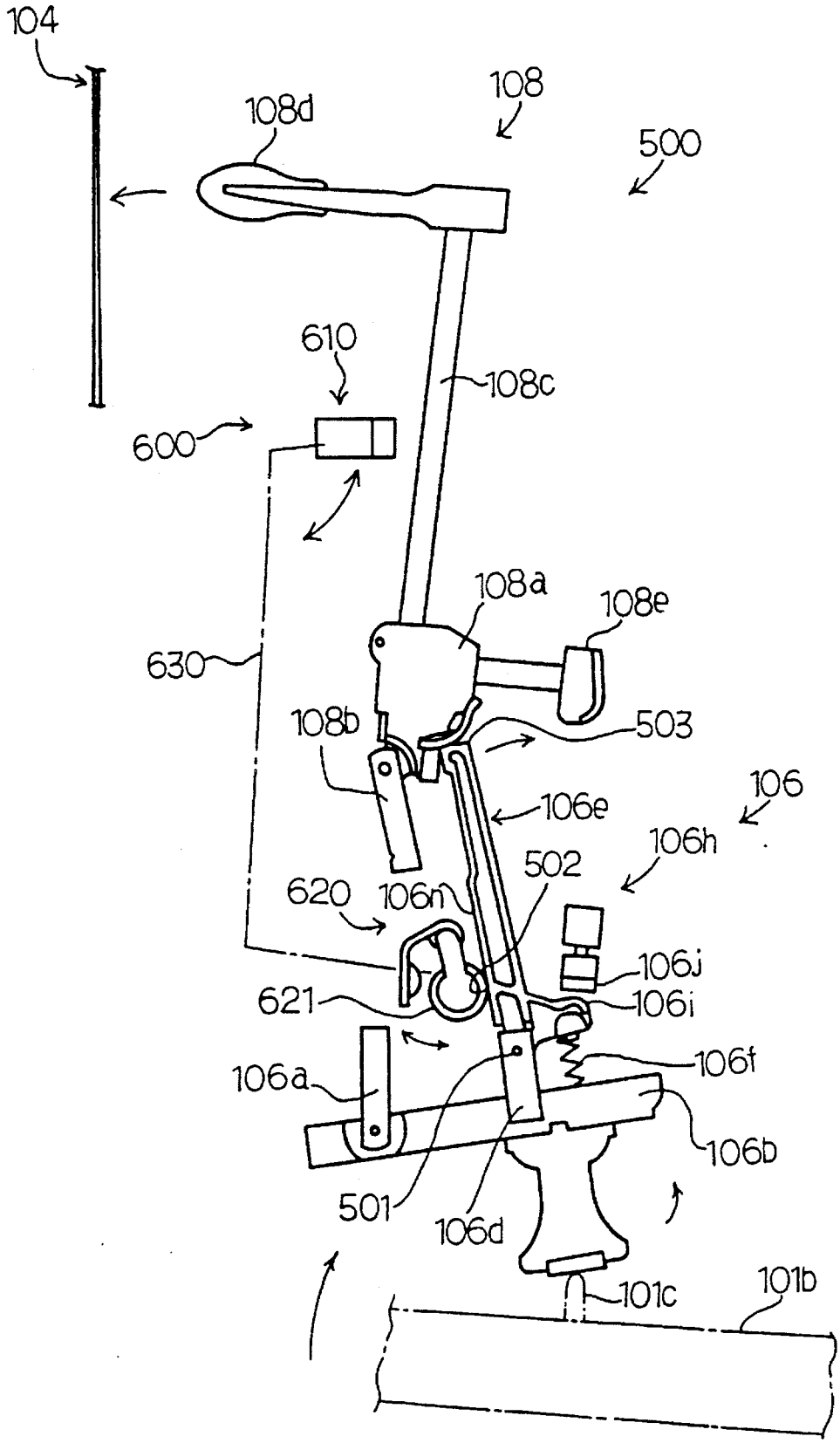
FIG. 10 is a side view showing another escape accelerator incorporated in a keyboard musical instrument according to the present invention.

FIG. 10 illustrates essential parts of another keyboard musical instrument embodying the present invention. The keyboard musical instrument implementing the second embodiment also largely comprises an acoustic piano 500, an electronic system (not shown) and a silent system 600. The acoustic piano 500 is similar to the acoustic piano 100, and component parts of the acoustic piano 500 are labeled with the same references as those of the acoustic piano 100 without detailed description.

The silent system 600 includes a hammer stopper sub-system 610, an escape accelerating sub-system 620 and a link mechanism 630, and the hammer stopper sub-system 610 and the link mechanism 630 are similar to those of the first embodiment. For this reason, description is focused on the escape accelerating sub-system 620 only for the sake of simplicity.

The escape accelerating sub-system 620 is implemented by a reaction generator 621 only. As to the reaction generator 621, the contact point with the jack in the active position is limited, and a cum is not provided on the jack 106*e*. In other words, the reaction generator 621 is similar to the reaction generator 310 except for the cum 310 and the contact point with the jack 106*e*. In detail, the jack 106*e* is turnable around the jack flange 106*d*, and a pin 501 provides a center of the turning motion. The reaction generator 621 is arranged in such a manner that the distance between the pin 501 and a contact point with the rear surface 106*n* is shorter than the distance between the pin 501 and the swell portion 106*i*. In this instance, the reaction generator 621 serves as a reaction generating means.

In the silent mode, the jack 106*e* is brought into contact with the reaction generator 621 at the point 502, and the point 502 provides a reaction point to the turning motion of the jack 106*e*. Since the distance between the pin 501 and the point 502 is shorter than the distance between the pin 501 and the swell portion 106*i*, the angular velocity at the leading end 503 of the jack 106*e* is larger than the angular velocity in the acoustic sound mode, and the jack 106*e* completes the escape in the silent mode earlier than the escape in the acoustic sound mode.

The rear surface 106*n* of the jack 106*e* is brought into contact with the reaction generator 621 substantially in concurrence with the contact between the swell portion 106*i* and the regulating button 106*j*, and, for this reason, the player feels the key touch unchanged. However, the jack 106*e* completes the escape in the silent mode earlier than the escape in the acoustic sound mode, and the hammer shank 108*c* never get between the jack 106*e* and the hammer stopper 610.

The escape accelerating sub-system 620 is simpler than the escape accelerating sub-system 330, and achieves all the advantages over the prior arts.

Although particular embodiments of the present invention have been shown and described, it will be obvious to those skilled in the art that various changes and modifications may be made without departing from the spirit and scope of the present invention.

For example, the upright piano may be replaced with another keyboard musical instrument such as, for example, a grand piano, a harpsichord or a celesta. If a grand piano is used, the term "hammer butt" is read as "hammer roller", then the description is applicable to the keyboard musical instrument having the grand piano.

The keyboard musical instrument according to the present invention may be equipped with an automatic playing system for reproducing a performance by selectively actuating the keys. In this instance, the keyboard musical instrument according to the present invention further has a playback mode and/or a recording mode.

The hammer stopper 320 and the reaction generator 330 may be changed by means of an electric motor unit or a solenoid-operated actuator, and may be respectively associated with change-over means for independently changing the positions.

Finally, the hammer stopper sub-system may have a plurality of cushion peaces moved in a lateral direction by a half of the pitch between the adjacent hammer shanks. In this instance, if the cushion peaces are opposed to the hammer shanks in the silent mode, the hammer shanks rebound on the cushion peaces. However, if the cushion peaces are moved by the half pitch, the hammer shanks pass the gaps between the cushion peaces.

What is claimed is:

1. A keyboard musical instrument having at least an acoustic sound mode for a performance through acoustic sounds and a silent mode for a performance without an acoustic sound, comprising:

an acoustic keyboard instrument including a keyboard having a plurality of keys respectively assigned notes of a scale and selectively depressed by a player in both of said acoustic sound mode and said silent mode, a plurality of key action mechanisms functionally connected to said plurality of keys, respectively, and having respective jacks and a regulating sub-mechanism associated with said jacks, said jacks being brought into contact with said regulating sub-mechanism so as to start escapes when said plurality of keys are depressed by said player in said acoustic sound mode, a plurality of hammer assemblies respectively associated with said plurality of key action mechanisms and respectively driven for rotation through said escapes of said jacks by said plurality of key action mechanisms when said player selectively depresses said plurality of keys, and a plurality of string means respectively assigned said notes and respectively struck by said plurality of hammer assemblies for producing acoustic sounds in said acoustic sound mode; and a silent system including a hammer stopper changed between a free position in said acoustic sound mode and a blocking position in said silent mode, said plurality of hammer assemblies being allowed to strike said plurality of string means without an interruption of said hammer stopper in said free position, said plurality of hammer assemblies rebounding on said hammer stopper in said blocking position before a strike at said string means, and an escape accelerator associated in said plurality of key action mechanisms and causing said jacks to complete said escapes in said silent mode earlier than said acoustic sound mode.

2. The keyboard musical instrument as set forth in claim 1, further comprising an electronic system responsive to key motions of the keys depressed by said player in said silent mode for generating electronic sounds having the notes of said scale corresponding to said keys depressed by said player.

3. The keyboard musical instrument as set forth in claim 2, in which said escape accelerator starts an acceleration of said escape at said starting point.

4. The keyboard musical instrument as set forth in claim 1, in which said escape accelerator starts an acceleration of said escape at said starting point.

5. The keyboard musical instrument as set forth in claim 1, in which said escape accelerator includes a reaction generator changed between an inactive position in said acoustic sound mode and an active position in said silent mode, and cam members respectively attached to surfaces of said jacks and engaged with said reaction generator maintained in said active position when said plurality of keys depressed by said player move said plurality of key action mechanisms, each of said cam members engaged with said reaction generator forcing the associated jack to complete the escape in said silent mode earlier than the escape in said acoustic sound mode.

6. The keyboard musical instrument as set forth in claim 5, in which each of said cam members has a first surface spaced from the surface of the associated jack and a second surface connecting said surface of said associated jack to said first surface, an engaging point with said reaction generator being moved from said surface of said associated jack, said second surface and said first surface so as to force said associated jack to escape from the associated hammer assembly.

7. The keyboard musical instrument as set forth in claim 4, in which the surface of said associated jack is engaged with said reaction generator substantially in concurrence with said contact between said jack and said regulating button sub-mechanism.

8. The keyboard musical instrument as set forth in claim 6, further comprising an electronic system responsive to key motions of the keys depressed by said player in said silent mode for generating electronic sounds having the notes of said scale corresponding to said keys depressed by said player.

9. The keyboard musical instrument as set forth in claim 5, in which said silent system further includes a link mechanism connecting said hammer stopper to said reaction generator so as to synchronize a change between said free position and said blocking position with a change between said inactive position and said active position.

10. The keyboard musical instrument as set forth in claim 9, in which said link mechanism has an adjusting sub-mechanism for regulating said active position of said reaction generator with respect to said jacks.

11. The keyboard musical instrument as set forth in claim 1, in which said escape accelerator includes a reaction generating means changed between an inactive position in said acoustic sound mode and an active position in said silent mode, each of said jacks being engaged with said reaction generating means maintained in said active position so as to be forced to escape from the associated hammer assembly, a distance between a turnably supporting point of said each of said jacks and an engaging point with said reaction generating means being shorter than a distance between said turnably supporting point and the contact point with said regulating button sub-mechanism.

12. The keyboard musical instrument as set forth in claim 11, in which said silent system further includes a link mechanism connecting said hammer stopper to said reaction generating means so as to synchronize a change between said free position and said blocking position with a change between said inactive position and said active position.

13. The keyboard musical instrument as set forth in claim 12, in which said link mechanism has an adjusting sub-mechanism for regulating said active position of said reaction generating means with respect to said jacks.

14. The keyboard musical instrument as set forth in claim 11, further comprising an electronic system responsive to key motions of the keys depressed by said player in said silent mode for generating electronic sounds having the notes of said scale corresponding to said keys depressed by said player.

* * * * *